United States Patent [19]

Miller

[11] Patent Number: 4,988,098

[45] Date of Patent: Jan. 29, 1991

[54] ROTATOR CUFF EXERCISE MACHINE

[75] Inventor: James M. Miller, Grand Prairie, Tex.

[73] Assignee: Sport Supply Group, Inc., Farmers Branch, Tex.

[21] Appl. No.: 569,361

[22] Filed: Aug. 15, 1990

Related U.S. Application Data

[63] Continuation of Ser. No. 427,195, Oct. 26, 1989, abandoned.

[51] Int. Cl.[5] ..... A63B 21/00

[52] U.S. Cl. ..... 272/134; 272/67; 272/118

[58] Field of Search ..... 272/67, 94, 117, 118, 272/123, 134, 143

[56] References Cited

U.S. PATENT DOCUMENTS

| | | | |
|---|---|---|---|
| 3,089,700 | 5/1963 | Hotas | 272/117 |
| 4,239,210 | 12/1980 | Lambert, Jr. | 272/118 |
| 4,258,913 | 3/1981 | Brentham | 272/67 |
| 4,500,089 | 2/1985 | Jones | 272/117 |
| 4,553,747 | 11/1985 | Pursley | 272/118 |
| 4,621,807 | 11/1986 | Stramer | 272/117 |
| 4,666,149 | 5/1987 | Olschansky et al. | 272/134 X |
| 4,878,663 | 11/1989 | Luquette | 272/134 |

FOREIGN PATENT DOCUMENTS 2742106 3/1979 Fed. Rep. of Germany ..... 272/117

*Primary Examiner*—Robert Bahr

*Attorney, Agent, or Firm*—David H. Judson

[57] ABSTRACT

A machine for exercising the rotator cuff of a user includes an upright support frame having a front, a top, first and second sides defining a plane of the upright support frame, and a support structure extending from the front adjacent the top of the upright support frame. The machine preferably includes a forearm support assembly for supporting a forearm of the user in a plane substantially transverse to the plane of the upright support frame, wherein the transverse plane also passes through the shoulders of the user such that the user's arm is positioned substantially in the transverse plane to isolate the user's rotator cuff. A tension mechanism is mounted on the upright support frame and includes a tensioned cable. A cam mechanism is connected to the tensioned cable and supported by the support structure of the upright support frame for rotation with the forearm support assembly under tension as the user's forearm is rotated.

9 Claims, 3 Drawing Sheets

ROTATOR CUFF EXERCISE MACHINE

This application is a continuation of application Ser. No. 07/427,195, filed Oct. 26, 1989 now abandoned.

TECHNICAL FIELD

The present invention relates generally to exercise apparatus and more specifically to a machine for exercising the rotator cuff muscle group.

BACKGROUND OF THE INVENTION

The rotator cuff is a muscle group surrounding the shoulder joint. Its primary purpose is to stabilize and strengthen the joint and to enable rotation of the arm.

Rotator cuff exercising devices are known in the prior art. For example, U.S. Pat. No. 4,553,747 to Pursley describes one such machine that includes an upright support frame and first and second body support members spaced from the upright support member along a plane parallel thereto. The first body support member is a seat upon which the user is seated and the second body support member receives the user's upper arm. Because the first and second support members are located in the same parallel plane, the rotator cuff muscle group can be isolated. The exercise machine shown in the Pursley patent also includes a handle attached to a cable that is, in turn, connected to one or more weights. When the user is properly positioned in the seat with his or her arm in the second body support member, the handle is grasped and moved against the pull of the weights to thereby enable external and internal rotation in abduction exercises. In an alternate embodiment, the seat is removed and the user stands at a 90 degree angle with respect to the machine to thereby enable external and internal rotation to adduction exercises.

While the machine described in the Pursley patent does provide isolation of the rotator cuff, the user's forearm is unsupported and thus must be carefully controlled during the exercises to retain this isolation. Moreover, because the forearm is not supported, the exercises can put additional stress on the wrist and elbow. It would therefore be desirable to provide a rotator cuff exercise machine that isolates the rotator cuff muscle group, yet can provide effective and comfortable support of the forearm during the rotator cuff exercises.

BRIEF SUMMARY OF THE INVENTION

It is an object of the present invention to provide a rotator cuff exercise machine that effectively isolates the rotator cuff yet provides sufficient support for the user's forearm during the rotator cuff exercises.

It is yet another object of the invention to provide such an exercise machine that is simple to construct, has few moving parts and is reliable and simple to use in operation.

It is still another object of the present invention to provide a rotator cuff exercise machine that can be easily adapted for use by athletes of different physical sizes and can be adjusted to provide varying degrees of external and internal rotation of the shoulder joint.

These and other objects are achieved by a novel rotator cuff exercise machine according to the present invention. In the preferred embodiment, the machine includes an upright support frame having a front, a top, first and second sides defining a plane of the upright support frame, and support means extending from the front adjacent the top of the upright support frame. The machine advantageously includes a forearm support assembly for supporting a forearm of the user in a plane substantially transverse to the plane of the upright support frame, wherein the transverse plane also passes through the shoulders of the user such that the user's arm is positioned substantially in the transverse plane to isolate the user's rotator cuff. A tension mechanism is mounted on the upright support frame and includes a tensioned cable. The machine further includes a cam connected to the tensioned cable and supported by the support means of the upright support frame for rotation with the forearm support assembly under tension as the user's forearm is rotated.

The rotator cuff exercising machine may also include a body support member spaced from the upright support frame and including a vertically-adjustable seat positioned in front of said forearm support assembly for supporting the user in a seated position facing transversely to the plane of the upright support frame. The seat and the forearm support assembly are positioned in the plane that passes through the shoulders of the user such that the user's arm is positioned substantially in the plane passing through the user's shoulders to isolate the rotator cuff as the user rotates the forearm support assembly.

According to the invention, the support means of the upright support frame preferably comprises a generally u-shaped cross member, a generally l-shaped brace member and a pulley mechanism. The cross member has a first portion, a second portion and an intermediate portion, the cross member extending transversely from the front of the upright support member. The l-shaped brace member preferably has a first portion and a second portion, an end of the first portion of the brace member being attached to the intermediate portion of the cross member and an end of the second portion of the brace member being attached to the top of the upright support frame. In the preferred embodiment, the pulley mechanism is supported by the brace member and comprises first and second pulleys supported on the second portion of the brace member, and third and fourth pulleys supported on the first portion of the brace member.

The tension mechanism includes a cable for biasing the forearm support assembly. The cable is passed through the top of the upright support frame, extends over the first and second pulleys and then passes between the third and fourth pulleys. A shaft is supported by the u-shaped cross member of the support means and includes an end secured to the forearm support assembly. The cam is journaled to the shaft and rotatable therewith, and includes means for securing an end of the tensioned cable after the cable extends over a pulley mechanism.

According to another feature of the invention, the forearm support assembly comprises a bar member attached to the end of the shaft, a generally u-shaped forearm support member secured to the bar member for receiving the user's forearm, and a handle secured to the bar member and adapted to be grasped by the user after the user's forearm is received in the forearm support member. The forearm support assembly also includes means for adjusting the position of the handle relative to the bar member and means for adjusting the radial position of the forearm support assembly relative to the cam.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
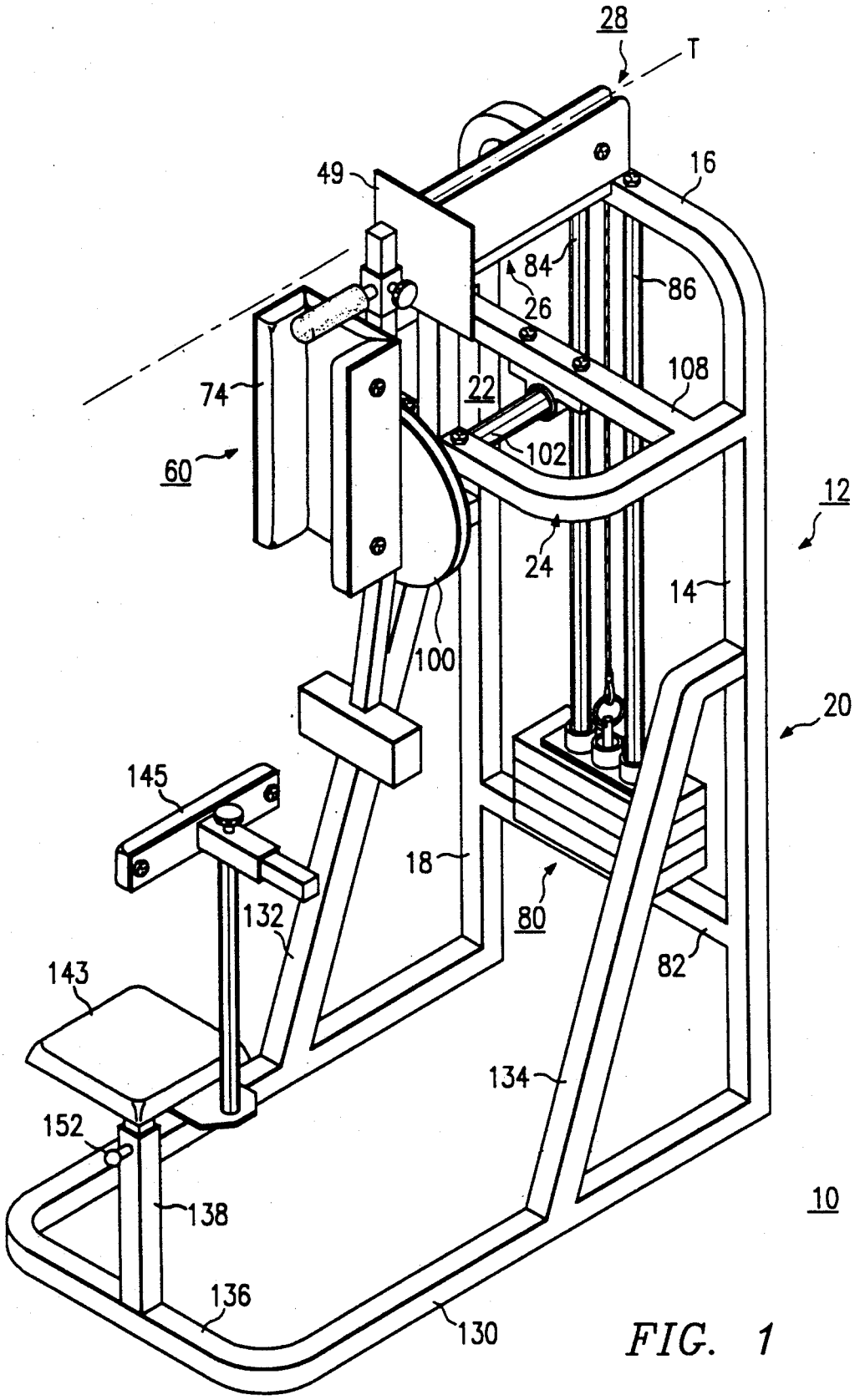
FIG. 1 is a perspective view of the rotator cuff exercise machine of the present invention.
Figure 2:
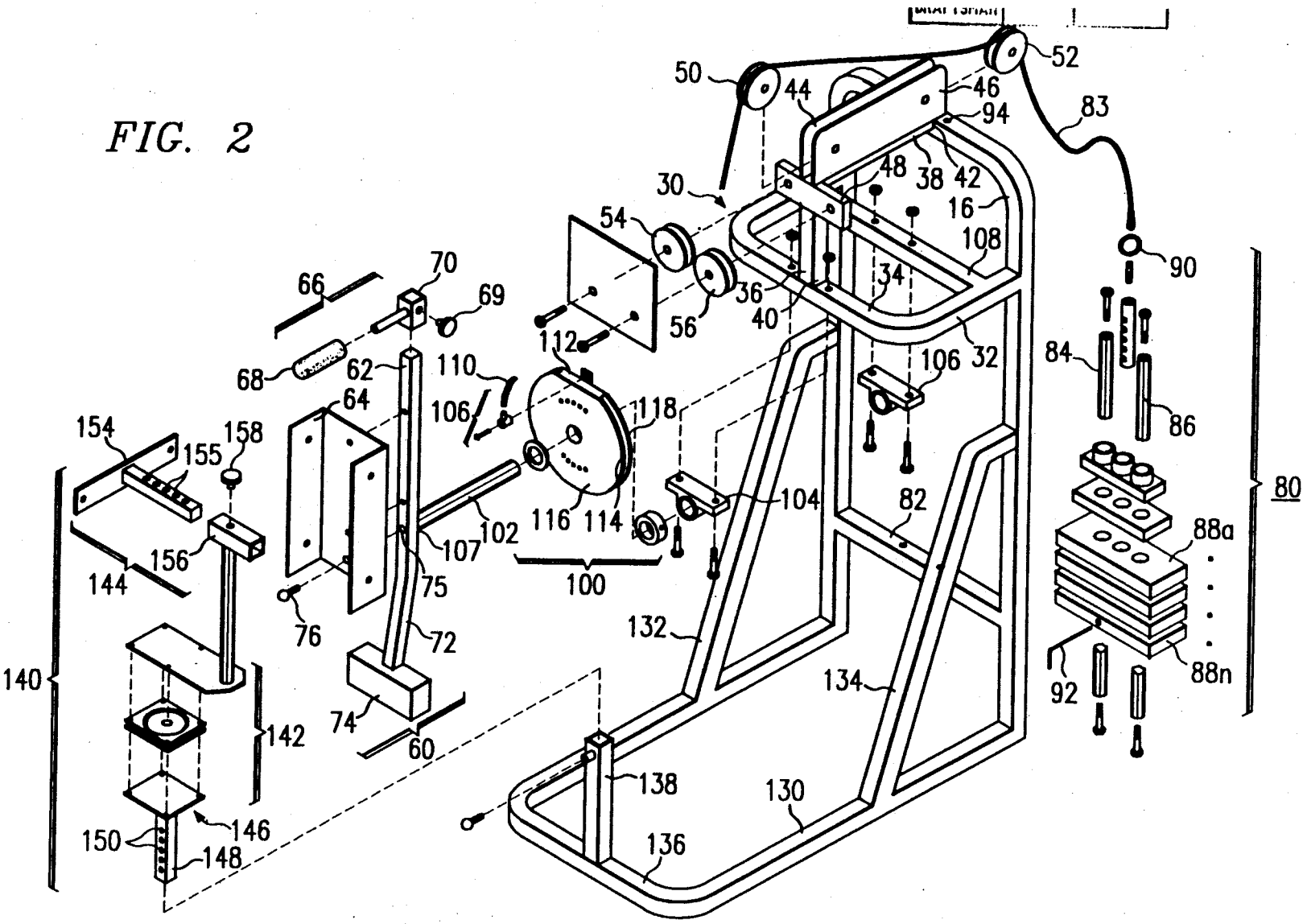
FIG. 2 is a exploded view of the exercise machine shown in FIG. 1 showing the detailed mechanisms that facilitate isolation of the rotator cuff and support of the user's forearm during use of the machine.
Figure 3:
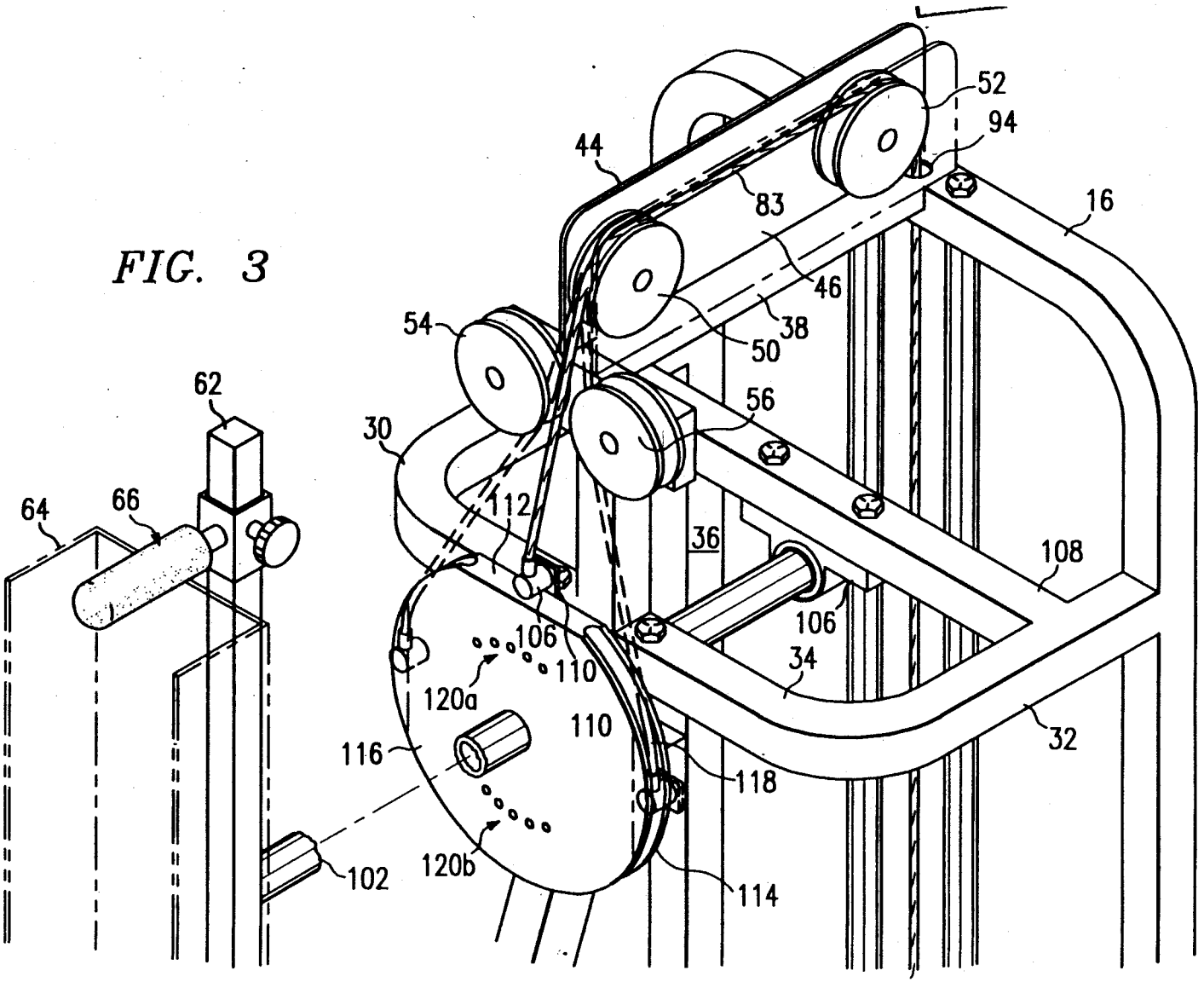
FIG. 3 is a detailed close-up view of the support means and cam mechanism of the present invention.

Referring simulataneously to FIGS. 1-3, the rotator cuff exercise machine 10 includes a generally upright support frame 12 having a front 14, a top 16, and first and second sides 18 and 20 defining a plane of the upright support frame 12. A support structure 22 extends from the front 14 adjacent the top 16 of the upright support frame and preferably includes a generally u-shaped cross member 24, a generally l-shaped brace member 26 and a pulley mechanism designated by the reference numeral 28. The cross member 24 has a first portion 30, a second portion 32 and an intermediate portion 34, the cross member extending generally transversely from the front 14 of the upright support frame 12. The l-shaped brace member 26 preferably has a first portion 36 and a second portion 38, with an end 40 of the first portion 36 of the brace member being attached to the intermediate portion 34 of the cross member and an end 42 of the second portion 38 of the brace member being attached to the top 16 of the upright support frame.

In the preferred embodiment, the pulley mechanism 28 is supported by the brace member 26 by opposed mounting brackets 44 and 46, and by a member 48 attached to the first portion 36 of the brace member. In particular, the pulley mechanism comprises first and second pulleys 50 and 52 supported by and between the mounting brackets 44 and 46 on the second portion 38 of the brace member, and third and fourth pulleys 54 and 56 supported by the member 48 attached to the first portion 36 of the brace member. If desired, a cover plate 49 can be used to cover the pulleys 54 and 56.

According to one important feature of the invention, the exercise machine includes a forearm support assembly 60 for supporting a forearm of the user in a plane T substantially transverse to the plane of the upright support frame 12. As will be described below, the transverse plane T also passes through the shoulders of the user such that the user's arm is positioned substantially in said transverse plane to isolate the user's rotator cuff. Preferably, the forearm support assembly 60 comprises a bar member 62, a generally u-shaped forearm support member 64 secured to the bar member for receiving the user's forearm, and a handle 66 secured to the bar member 62 and adapted to be grasped by the user after the user's forearm is received in the forearm support member 64. The handle 66 includes a grip 68 and a hollow rectangular base 70 adapted to be slidably received on the bar member 62. Mounting holes are suitably located on the bar member 62 to enable the position of the handle relative to the bar member to be adjusted by pin 69 depending on the length of the user's forearm. Alternatively, the rod supporting the grip 66 can be threaded into a slidable bolt extending from an elongated slot in the front face of the bar member 62. The forearm support member 64 is secured to the bar member by welding or suitable screws.

In the preferred embodiment of FIG. 1, the forearm support member 64 is provided with cushions 74 (as seen in FIG. 1) to provide extra comfort and support for the user's forearm. To increase stability during rotation, the bar member 62 includes an angled end portion 72 that terminates in a t-shaped member 74. The bar member 62 also includes a hole 75 adjacent the angled end portion 72 for receiving a spring-loaded alignment pin 76 that passes completely through the hole 74 for the purposes to be described below.

The rotator cuff exercise machine 10 further includes a tension mechanism indicated generally by the reference numeral 80. Tension mechanism 80 is mounted on cross member 82 near the lower end of the upright support frame 12 and includes a cable 83 and a pair of guide rails 84 and 86 that are positioned parallel to each other and extend between the top 16 and the cross member 82 of the upright support frame 12. A plurality of weights **88*a*–88*n* are connectible to the cable by bolt 90 and are adapted to slide on guide rails 84 and 86 in a manner known in the prior art. The number of weights attached to the cable is determined by a pin 92 that slides through an opening (not shown) in one of the weights 88** in a conventional manner.

Tension cable 83 extends up through a hole 94 in the top 16 of the upright support frame, over first and second pulleys 50 and 52 supported by the second portion of the brace member, through a space between the third and fourth pulleys 54 and 56 supported on the first portion of the brace member, and is then attached to a cam mechanism designated generally by the reference numeral 100. As further seen in FIGS. 2 and 3, the rotator cuff exercise machine further includes a shaft 102 supported by journal brackets 104 and 105, with journal bracket 104 being supported underneath the intermediate portion 34 of the cross member 24 and journal bracket 105 supported underneath a member 108 attached between the first and second portions 30 and 32 of the cross member 24. A distal end 107 of the shaft 102 is rigidly secured to the bar member 62 of the forearm support assembly 60. As best seen in FIG. 3, the cam mechanism 100 is journaled to the shaft 102 and rotatable therewith, and includes a pin 106 for securing an end 110 of the tensioned cable 83 to the cam mechanism. The cam mechanism comprises a first substantially flat portion 112, a second substantially circular portion 114 and a facing portion 116. The circular portion 114 of the cam has a groove 118 in an outer peripheral surface thereof for receiving the tensioned cable 83 as the forearm support assembly 60 is rotated by the user. This rotation is shown in phantom in FIG. 3. As also seen in FIG. 3, the end 110 of the tensioned cable 83 is supported on the flat portion 112 of the cam.

The facing portion 116 of the cam 100 also includes opposed sets of alignment holes 120*a* and 120*b*, one of which receives the end of the pin 76. Accordingly, the position of the forearm support assembly 60 with respect to the cam mechanism 100 is thus also radially adjustable to define the angle at which the rotational exercise is initiated. When the handle 66 is in the "top" position shown in FIG. 1, the end of the pin 76 is located in one of the holes 120*b* in the cam and the forearm support assembly is rotatable in a downward direction. If desired, the forearm support assembly 60 can be placed in a position opposite that shown in FIG. 1 by retracting the end of the pin 76 and rotating the assembly about the shaft. When the assembly 60 is in the desired starting position, the end of the pin 76 is then engaged with one of the holes 120*a* and the assembly can be rotatable in an upward direction.

Therefore, according to the invention, the cam 100 is connected to the tensioned cable 83 and supported by the support means of the upright support frame for rotation with the forearm support assembly 60 under tension as the user's forearm is rotated.

The rotator cuff exercise machine may further include a base frame 130 attached to the front 12 of the upright support frame. Preferably, the base frame 130 includes angled support members 132 and 134 for additional support and stability. The base frame 130 further includes a front member 136 on which is mounted a hollow member 138. Member 138 is adapted to receive a body support member 140 spaced from the upright support frame 12 for supporting the user in a seated position. The body support member preferably includes a rotatable seat 142 (as best seen in FIG. 2) and associated back rest 144. Both the seat and the back rest preferably include cushions 143 and 145, respectively, as shown in FIG. 1. The body support member 140 includes a seat support 146 and a shaft 148 adapted to be slidably received in the hollow member 138. The shaft 148 includes spaced alignment holes 150 and thus the position of the seat can be vertically adjusted through removing the alignment pin 152 and moving the seat to the appropriate vertical position. Likewise, the back rest 144 includes a t-shaped support member 154 having alignment holes 155, a hollow bracket 156 and a suitable adjustment pin 158. The position of the support member 154 relative to the seat can therefore by adjusted.

In the preferred embodiment, the body support member 140 including the seat is positioned in front of said forearm support assembly for supporting the user in a seated position facing transversely to the plane of the upright support frame. In this position, the seat and the forearm support assembly are positioned in the plane T that passes through the shoulders of the user such that the user's arm is positioned substantially in said plane passing through the user's shoulders to isolate the rotator cuff. As the user rotates the forearm support assembly, the tensioned cable is rotated about the cam and thereby lifts the weights.

Each of the frame members may be rectangular metal tubing and the upright support and base frames can be welded together or otherwise secured by suitable nuts and bolts. Mounting plates (not shown) may be selectively attached to base frame for securing the machine 10 to the floor of an exercise room, gym or the like.

It should be appreciated by those skilled in the art that the specific embodiments disclosed above may be readily utilized as a basis for modifying or designed other structures for carrying out the same purposes of the present invention. It should also be realized by those skilled in the art that such equivalent constructions do not depart from the spirit and scope of the invention as set forth in the appended claims.

What is claimed is:

1. A machine for exercising the rotator cuff of a user, comprising:

a frame;

a body support member spaced from the frame and including a seat for supporting the user in a seated position facing transversely to the frame;

a load supported on the frame;

an input mechanism that is operably coupled by a cable and a system of pulleys for enabling the user to perform rotator cuff exercises against said load while in the seated position, the input mechanism comprising:

a shaft supported by the frame and including an end;

a forearm support assembly rotatable with the shaft, the forearm support assembly for supporting a forearm of the user and including a bar member attached to the shaft end and having first and second ends, a handle secured adjacent the first end and means at the second end for stabilizing the forearm support assembly during rotation;

a cam journaled to the shaft and rotatable therewith and including a face having first and second sets of diametrically opposed alignment holes, the cam further including a periphery to which an end of the cable is tethered such that the forearm support assembly is freely rotatable in a 360 degree manner with respect to the cam to enable the user to locate the handle in an initial downward position or an initial upward position while remaining in the seated position; and adjustment means supported by the forearm support assembly and cooperating with the first and second sets of alignment holes for selectively positioning the forearm support assembly relative to the shaft, wherein the adjustment means is aligned with one of the holes of the first set to enable the forearm support assembly to be rotated against the load from the initial downward position to an upward position in a first direction or aligned with one of the holes of the second set to enable the forearm support assembly to be rotated against the load from the initial upward position to a downward position in a second opposed direction.

2. The machine as described in claim 1 wherein the frame comprises:

an upright support frame having a front, a top, and first and second sides;

a generally u-shaped cross member having a first portion, a second portion and an intermediate portion, the cross member extending transversely from the front of the upright support frame; and a generally l-shaped brace member having a first portion and a second portion, end of the first portion of the brace member being attached to the intermediate portion of the cross member and an end of the second portion of the brace member being attached to the top of the upright support frame;

wherein the system of pulleys is supported by the brace member.

3. The machine as described in claim 2 wherein the system of pulleys comprises:

first and second pulleys supported on the second portion of the brace member; and third and fourth pulleys supported on the first portion of the brace member;

wherein the cable is passed through the top of the upright support frame, extends over the first and second pulleys and then passes between the third and fourth pulleys.

4. The machine as described in claim 1 wherein the periphery of the cam includes a groove for supporting the cable as the forearm support assembly is rotated by the user.

5. The machine as described in claim 1 including means for adjusting the vertical height of the seat.

6. The machine as described in claim 1 wherein the forearm support assembly further comprises:

a generally u-shaped forearm support member secured to the bar member for receiving the user's forearm.

7. The machine as described in claim 1 further including means for adjusting the position of the handle relative to the bar member.

8. The machine as described in claim 1 wherein the means for stabilizing comprises an angled end portion of the bar member terminating in a t-shaped member.

9. The machine as described in claim 1 wherein the periphery of the cam is defined by a circular portion bisected by a substantially flat portion, the flat portion including means for securing the cable end.

* * * * *